United States Patent [19]

Hirakawa et al.

[11] Patent Number: 4,481,066

[45] Date of Patent: Nov. 6, 1984

[54] SINGLE FACER

[75] Inventors: Tadashi Hirakawa; Hiroaki Sasashige, both of Mihara, Japan

[73] Assignee: Mitsubishi Jukogyo Kabushiki Kaisha, Japan

[21] Appl. No.: 585,138

[22] Filed: Mar. 1, 1984

Related U.S. Application Data

[63] Continuation of Ser. No. 374,332, May 3, 1982, abandoned.

[30] Foreign Application Priority Data

May 8, 1981 [JP] Japan ..... 56-690044

[51] Int. Cl.[3] ..... B31F 1/00

[52] U.S. Cl. ..... 156/472; 156/470; 156/547; 226/25; 226/170

[58] Field of Search ..... 156/470, 471, 472, 547, 156/473; 226/170–173, 37, 25

[56] References Cited

U.S. PATENT DOCUMENTS

| | | | |
|---|---|---|---|
| 3,372,849 | 3/1968 | Hall et al. | 226/25 |
| 3,455,767 | 7/1969 | Meister | 156/473 |
| 3,468,734 | 9/1969 | Shields | 156/471 |
| 3,546,846 | 12/1970 | Sens | 156/285 |
| 3,990,935 | 11/1976 | Lehman | 156/472 |
| 4,316,761 | 2/1982 | Hirakawa et al. | 156/472 |
| 4,337,884 | 7/1982 | Hirakawa et al. | 156/472 |

FOREIGN PATENT DOCUMENTS

| | | | |
|---|---|---|---|
| 24817 | 3/1981 | European Pat. Off. | 156/470 |

*Primary Examiner*—Jerome Massie

*Attorney, Agent, or Firm*—McGlew and Tuttle

[57] ABSTRACT

There is provided a single facer consisting of an upper roll, a lower roll, a pasting device and a pressure member in parallel with the lower roll for manufacturing single-faced corrugated board. The single facer is characterized by the provision of a suction conveyor having belts for conveying single-faced corrugated board, the suction conveyor being disposed at the side of another sheet in the transport passage of the single-faced corrugated board in the proximity of the engaging point between the lower roll and pressure member, thereby preventing the strip-off or separation of a contact portion between the corrugated sheet and another sheet by means of the structure, which is extremely simple and compact in form.

5 Claims, 8 Drawing Figures

SINGLE FACER

This is a continuation of application Ser. No. 374,332 filed May 3, 1982, now abandoned.

FIELD AND BACKGROUND OF THE INVENTION

This invention relates to improvements in a single facer.

Conventional single facers are shown in FIGS. 1 and 2.

In the conventional single facer shown in FIG. 1, there are provided an upper roll 1 having its external circumference formed into a corrugated shape and a lower roll 2 having the same external circumference as above in corrugated form. A sheet $S_1$, of card-board fed into the meshing portion between said upper and lower rolls 1 and 2 is processed into a corrugated sheet $S_2$. Subsequently, the corrugated sheet $S_2$ is brought into contact with a pasting roll 7 so that a paste 8 can be applied to the top portion of the corrugated sheet $S_2$ and, together with an another sheet $S_3$ supplied from other direction, it is pressed and heated by the engaging point between a pressure roll 3 and the lower roll 2 until it is finished as a single-faced corrugated board S. FIG. 3*a* and FIG. 3*b* show an enlarged view of the pressing and heating step of the sheets 2 and 3 by the engaging point between the lower roll 3 and the pressure roll 3.

In this case, it is apparent that there occurs a change say, δ in axial distance between the pressure roll 3 and the lower roll 2 in the process of engagement from FIG. 3*a* to FIG. 3*b*. Namely, as the lower roll 2 makes one rotation, there occurs as many vibrations as the number of the circumferential teeth between the lower roll 2 and the pressure roll 3. Therefore, these vibrations cause noises and in the case of a low-quality sheet, it tends to be damaged at the engaging point between the lower roll 2 and the pressure roll 3 in common practice under the present circumstances.

FIG. 2 shows also an another conventional example disigned to prevent the generation of the aforesaid vibrations. Namely, in place of the pressure roll 3 shown in FIG. 1, there is provided a pressure member 10 in a position facing the lower roll 2 as shown in FIG. 2, said pressure member having a diameter or a curved surface equal to, or a little larger than, the diameter of the lower roll 2 so that there occurs no change in distance between the pressure member 10 and the lower roll 2 from an engaging point A to another engaging one B, as shown in FIG. 4.

The pressure member 10 has a curved surface of a length larger than the distance l between the teeth of the lower roll 2 and the pressure member 10 is pressed against the lower roll 2 in order to keep the sheet $S_3$ and the corrugated sheet $S_2$ in close contact so that, in the process of the engaging point A to B shown in FIG. 4, a contact portion C between the sheet $S_3$ and the corrugated one $S_2$ is subjected to frictional force between the sheet $S_3$ and the pressure member 10. Under such circumstances, the sheet $S_3$ does not advance to the same extent as the amount of progress of the corrugated sheet $S_2$ with the result that there occurs a relative lag between both until the contact portion C becomes separated as a conventional drawback which has heretofore been common in practice.

At the same time, the aforesaid separation is sure to take place in the conventional example shown in FIG. 1. Namely, while the delivery of the required single-faced corrugated board S is to be accomplished by pressing force of the pressure roll 3 and the lower roll 2 against the rotation or resistance of inertia of a preheating roll 17 and a paper-winding roll (not shown), said pressing force is lowered for the prevention of cracking of said sheet $S_3$ so that said contact portion C tends to be stripped or separated. In like manner, frictional force is usually lowered owing to the same phase of amplitude in the proximity of common vibration point at the lower roll 2 and the pressure roll 3. As the result, there occurs a difference in relative speed between the corrugated sheet $S_2$ and the sheet $S_3$ until said contact portion C becomes likewise separated.

SUMMARY OF THE INVENTION

The present invention aims at removing and improving all the aforegoing drawbacks of conventional facers. So the object of the invention is to provide a single facer, extremely simple in operation and compact in structure.

Thus, the present invention can provide a single facer characterized by the fact that a suction conveyor is provided downstream of the engaging point between a lower roll and a pressure member, said suction conveyor having a belt speed equal to or a little larger than, the speed of external circumstance of the lower roll.

Another object of the invention is to provide a single facer which is designed to draw cardboard sheets by means of a conveyor so as to eliminate a difference in relative speed between the sheet and the corrugated sheet in a manner to prevent a strip-off phenomenon between both at their contact portion, thereby not only improving the quality of cardboard sheets but also enhancing their usable percentage.

BRIEF DESCRIPTION OF THE DRAWINGS

In the accompanying drawings.

Figure 1:
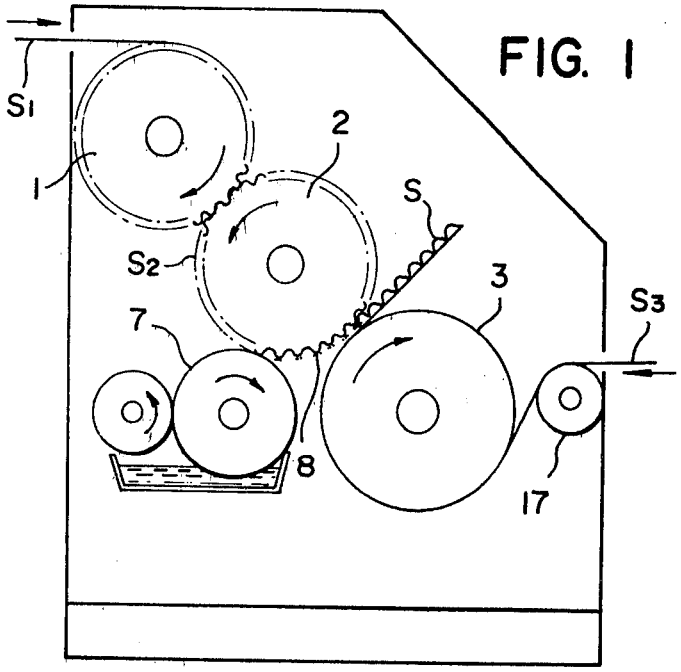
FIGS. 1 and 2 are explanatory views in outline of conventional different facers respectively.
Figure 2:
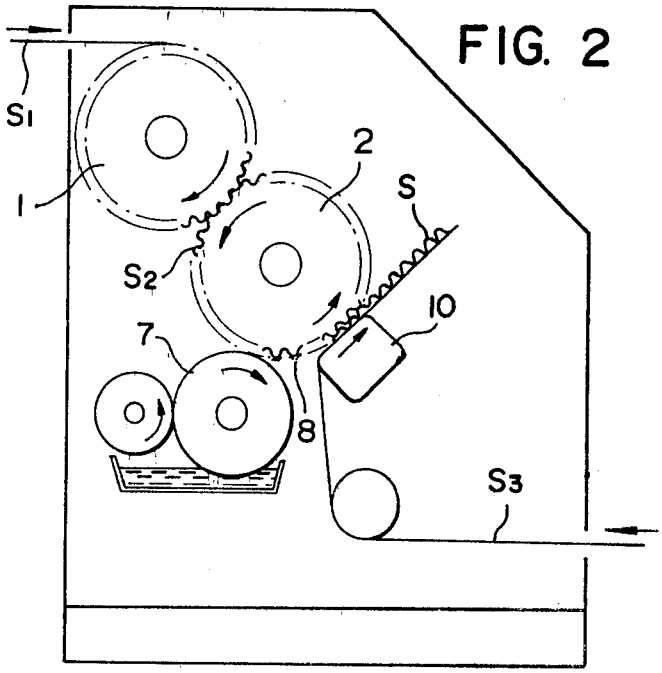
Figure 3A:
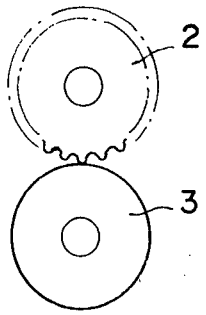
FIGS. 3(*a*) and (*b*) are explanatory views showing a condition of engagement between the lower roll and the pressure roll of conventional art shown in FIG. 1.
Figure 3B:
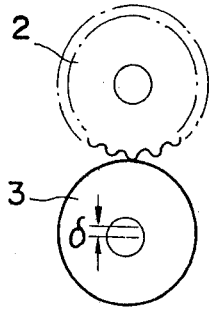
Figure 4:
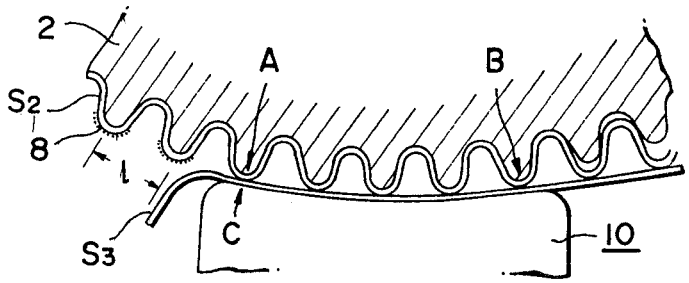
FIG. 4 is an enlarged view in part of the engaging point between the lower roll and the pressure member in cross section of conventional art shown in FIG. 2.
Figure 5:
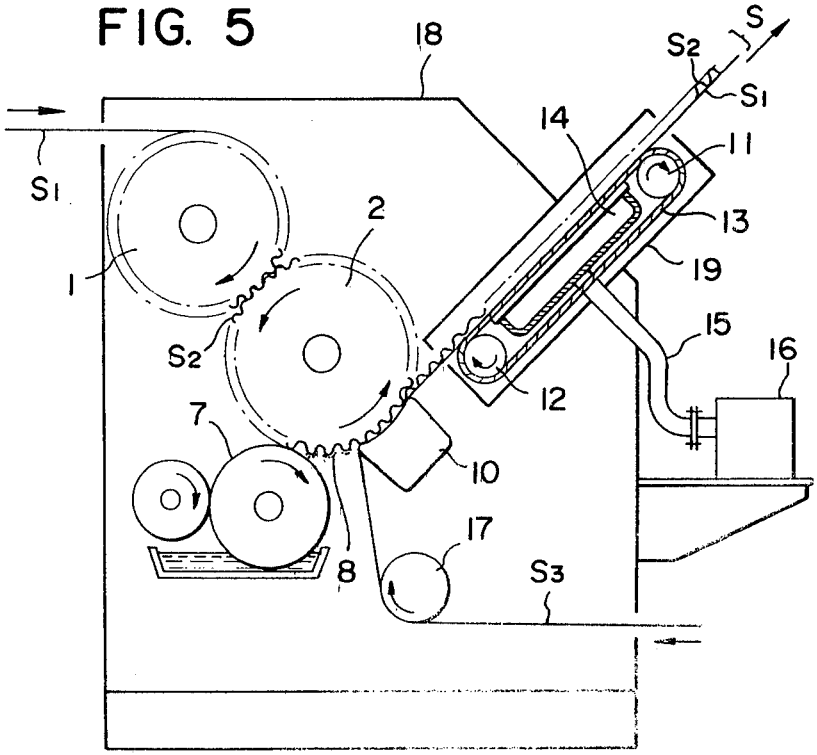
FIG. 5 is an explanatory view in outline showing a preferred embodiment broken in part.
Figure 6:
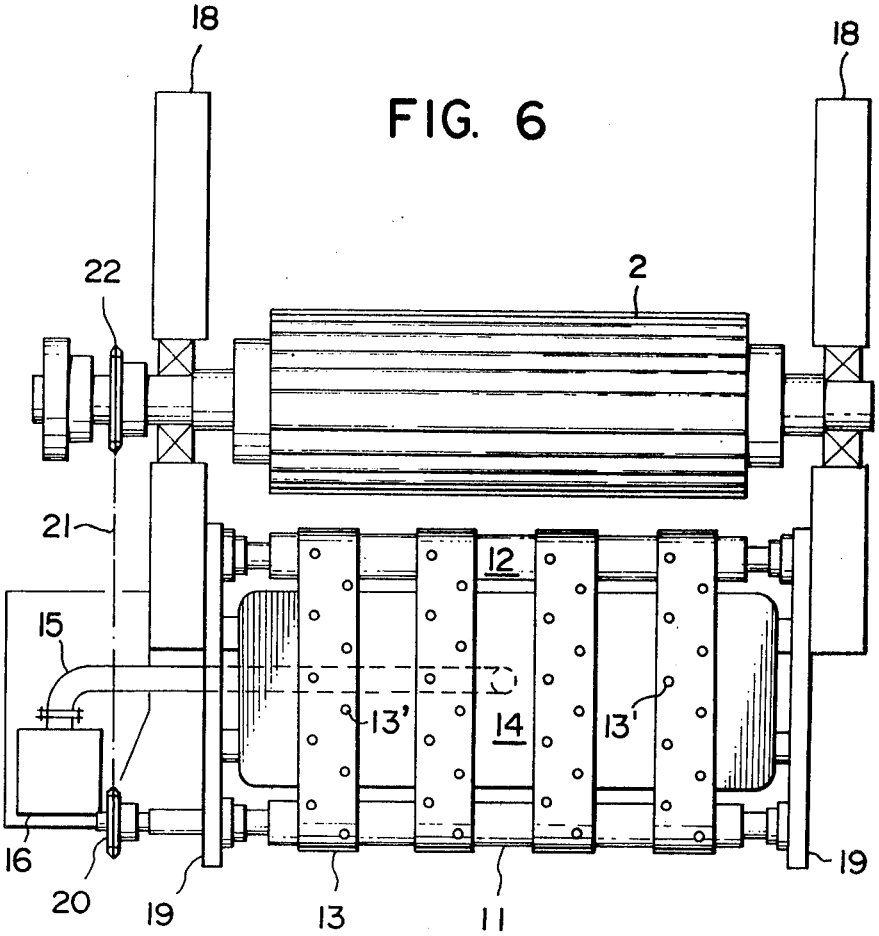
FIG. 6 is a plan view of the essential parts of the preferred embodiment shown in FIG. 5.

The invention will be explained with reference to FIGS. 5 and 6.

DESCRIPTION OF THE PREFERRED EMBODIMENT

Numeral 1 is an upper roll for guiding a sheet $S_1$, 2 a lower roll rotating in engagement with the upper roll 1, 7 a pasting roll for contact with the lower roll 2, 8 a paste adhering to the surface of the lower roll 2, 10 a pressure member provided in engagement with the lower roll 2 and having the same diameter as that of the lower roll 2 or a curved surface larger than that and adapted to pinch and hold a corrugated sheet $S_2$ between the lower roll 2 and the pressure member 10, a sheet or web sheet $S_3$ being conducted through a preheating roll or friction roll 17, 11 a driving shaft, 12 a driven shaft, 13 a plurality of belts constituting a suction conveyor, 13' a suitable number of suction holes formed in the belts, 14 a suction box provided at the lower side of the belts 13, 15 a duct connected to a suction blower 16, 18 and 19 frames, 20 a chain wheel for the driving shaft 11, 22 a chain wheel for the lower roll 2, the chain wheels 20 and 22 being connected together by means of a chain 21.

All the belts 13 are disposed near downstream of the engaging point between the lower roll 2 and the pressure member 10 and a plurality of belts 13 are provided in parallel so as to ensure a suitable distance between the ends of the adjacent belts 13. At the lower surface of these belts 13 is arranged the suction box 14, part of spacing therebetween being connected to the suction blower 16 through the duct 15. The driving shaft 11 and the driven shaft 12 are rotatably attached to the frame 19 which is secured to the frame 18. The power of the driving shaft 11 is transmitted by the chain wheel 20 secured to the end of the driving shaft 11 by means of a key, the chain wheel 22 secured to the end of shaft of the lower roll 2 and the chain 21, and the chain wheels 20 and 22 are selected such that the circumferential speed of the belts 13 can become equal to or a little larger than the circumferential speed of external diameter of the lower roll 2. Also, the transmission of power of the driving shaft 11 becomes possible by means of a speed-variable electric motor (not shown).

According to the structure of the present invention, the sheet $S_2$ processed into corrugated form due to meshing of the upper roll 1 and the lower roll 2 may be brought into contact with the pasting roll 7 so that the paste 8 can be applied to the top end of said corrugated form and said sheet $S_2$ together with the sheet $S_3$ supplied from other direction can be fed to the engaging point between the lower roll 2 and the pressure member 10 or a pressure roll (not shown) until they become a single-faced corrugated board S. Subsequently, the single-faced corrugated board S can be drawn in its condition closely attached to the belts 13 due to suction pressure of the suction blower 16 for supply to the next step.

In this preferred embodiment, as described hereinbefore, the single-faced corrugated board S can be brought into close contact with the belt 13 and drawn at the same speed as the circumferential speed of the lower roll 2 without slipping so that there occurs almost no difference in relative speed between the sheet $S_3$ and the corrugated sheet $S_2$ which may otherwise arise from frictional force between the sheet $S_3$ and the pressure member 10 or the rotation or resistance of inertia of the preheating roll 17 and a paper-winding roll (not shown), thereby preventing the strip-off or separation of the sheets $S_2$ and $S_3$ at the aforesaid contact portion C.

Figure 7:
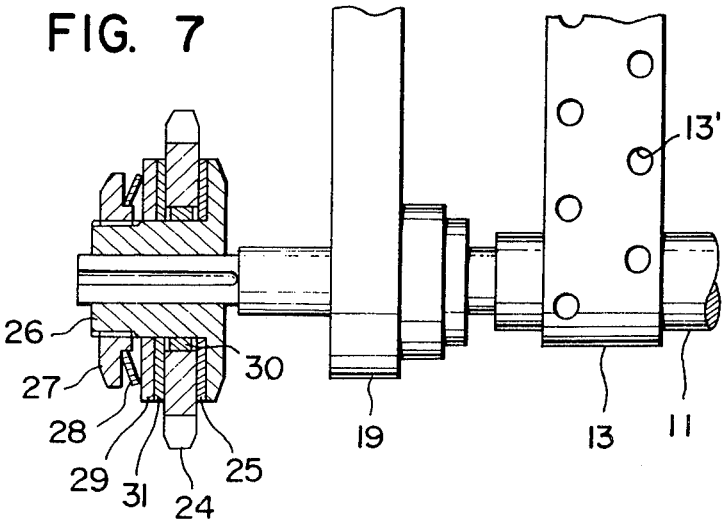
FIG. 7 is an explanatory partial view showing another preferred embodiment broken in part of the present invention.

FIG. 7 shows another preferred embodiment of the present invention wherein there is provided a mechanism for controlling the tension of sheets being fed from a paper roll portion.

In the drawing, the driving shaft 11 for driving the belt 13 is rotatably attached to the frame 19. A hub 26 is secured to the end of the driving shaft 11 by means of a key, and a check plate 29 and a friction plate 31 are adapted to slide in the axial direction on the external circumference of the hub 26. The external end of the hub 26 is formed into a threaded portion to which is applied a nut 27. A dish spring 28 is incorporated between the nut 27 and the check plate 29. The chain wheel 24 is also incorporated between the friction plates 25 and 31 and a bushing 30 and the chain wheel 24 are adapted to slide in the circumferential direction.

In the preferred embodiment shown in FIG. 7, the dish spring 28 can be resiliently transformed in shape by turning the nut 27 and its counter force acts as a contact power between the friction plate 31 and the chain wheel 24 and also between the friction plate 25 and the chain wheel 24 through the check plate 29.

On the assumption that said contact power is P, the friction coefficient between the friction plate 31 and the chain wheel 24 is $\mu$ and an effective diameter of action of said contact power is R, it is certain that a torque in the order of $2\ P\mu R$ can be transmitted to the driving shaft 11 of the belt 13 through the chain wheel 24 receiving power transmission from outside. Also, when a torque, more than $2\ P\mu R$ is transmitted, there occurs a slip action between the chain wheel 24 and the friction plate 31 until overloading on the driving shaft can be prevented.

Usually, it is a brake device only of a paper roll portion (not shown) that imparts tension to the sheet $S_3$ by adjustment. However, in the case of a preheating roll and a guide roll (both not shown) arranged between such paper roll portion and the pressure member 10, tension due to their frictional resistance acting on the sheet, web and the sheet $S_3$ at the outlet of the pressure member 10 tends to become fairly higher than a value which has been given previously at the paper roll portion.

Therefore, in the preferred embodiment shown in FIG. 7, on condition that the torque of transmission between the friction plates 25 and 31 and the chain wheel 24 is established as permissible tensile strength $T\times$(radius $\gamma$ of driving shaft 11+half t/2 of thickness of belt 13), it is possible to convey the sheet $S_3$ by means of the belt 13 without tearing the sheet $S_3$.

Moreover, in place of the aforesaid tensile strength adjusting mechanism an electromagnetic coupling may be used to achieve the same function as that of said preferred embodiment as a matter of course.

We claim:

1. A single facer comprising:

an upper corrugating roll;

a lower corrugating roll meshed with said upper corrugating roll in a meshing area lying on a feed path for a first sheet moving in a feed direction which is corrugated in said meshing area, said feed path extending around a portion of said lower roll downstream of said meshig area in said feed direction;

drive means connected to at least one of said upper and lower corrugating rolls for driving said corrugating rolls to move the first sheet in the feed direction along said feed path;

pasting means lying on said feed path downstream of said meshing area and associated with said lower roll for applying paste to the first sheet as it moves on said lower roll;

a pressure member for pressing a second sheet to the first sheet after it receives paste from said pasting means, said pressure member lying on said feed path and associated with said lower roll downstream of said meshing area in a pressing area;

feed means for feeding the second sheet to said pressing area for producing a single faced corrugated sheet having the second sheet facing said pressure member; and a suction conveyor lying on said feed path and spaced downstream of said pressing area for engaging the corrugated single faced sheet on a surface of the second sheet by suction and conveying the corrugated sheet in the feed direction along said feed path and downstream of said pressing area, said suction conveyor being separate from and spaced from said pressure member and comprising a plurality of belts for engaging the second sheet by suction and drive means for driving said belts in the feed direction and along said feed path at a speed at least equal to and at most only slightly greater than a circumferential speed of said lower corrugated roll moving in said feed path.

2. A single facer according to claim 1, wherein each of said belts is perforated, said suction conveyor including suction means for producing an underpressure on a side of each perforated belt facing away from said feed path.

3. A single facer according to claim 1, wherein said drive means of said upper and lower corrugated rolls and said drive means of said suction conveyor are connected to each other.

4. A single facer according to claim 3, including torque adjusting means connected between said drive means of said corrugated rolls and said drive means of said suction conveyor for transmitting an adjustable amount of torque to said drive means of said suction conveyor.

5. A single facer according to claim 4, wherein said torque adjusting means comprises a shaft engaged with each of said belts, a first friction wheel connected to said shaft for rotation therewith, a second friction wheel engageable with said first friction wheel and connected to said drive means of said corrugating rolls for rotation thereby and tension means for adjusting the amount of tension between said first and second friction wheels.

* * * * *

UNITED STATES PATENT OFFICE

CERTIFICATE OF CORRECTION

Patent No. 4,481,066 Dated Nov. 6, 1984

Inventor(s) Hirakawa et al

It is certified that error appears in the above-identified patent and that said Letters Patent are hereby corrected as shown below:

The number of the Japanese priority application is hereby corrected from "56-690044" to -- 56-69044--.

Signed and Sealed this

Ninth Day of April 1985

[SEAL]

*Attest:*

DONALD J. QUIGG

*Attesting Officer* *Acting Commissioner of Patents and Trademarks*